US012110749B1

(12) United States Patent
Lastra Melo et al.

(10) Patent No.: US 12,110,749 B1
(45) Date of Patent: Oct. 8, 2024

(54) WELLBORE TRACTOR WITH INVERTED TOROID

(71) Applicant: SAUDI ARABIAN OIL COMPANY, Dhahran (SA)

(72) Inventors: Rafael Adolfo Lastra Melo, Dhahran (SA); Faris Hasan Tulbah, Al Khubar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/124,454

(22) Filed: Mar. 21, 2023

(51) Int. Cl.
*E21B 23/00* (2006.01)

(52) U.S. Cl.
CPC ..... *E21B 23/001* (2020.05)

(58) Field of Classification Search
CPC ..... E21B 23/00; E21B 23/001
See application file for complete search history.

(56) References Cited

U.S. PATENT DOCUMENTS 2,941,537 A 6/1960 Watkins
3,797,445 A 3/1974 Zeimer
3,881,776 A * 5/1975 Fashbaugh ..... E21D 9/1093 405/289
4,036,254 A 7/1977 Alcalde
5,176,207 A * 1/1993 Keller ..... E21B 49/084 166/264
7,080,690 B2 * 7/2006 Reitz ..... E21B 43/121 166/372
7,191,838 B2 3/2007 Reitz
7,775,299 B2 8/2010 Khan et al.
9,518,426 B2 12/2016 Tunget
10,927,625 B2 2/2021 Fleckenstein et al.
2011/0308862 A1 * 12/2011 Downton ..... E21B 7/068 175/73

* cited by examiner

*Primary Examiner* — David Carroll
(74) *Attorney, Agent, or Firm* — Bracewell LLP; Constance G. Rhebergen; Keith R. Derrington

(57) ABSTRACT

A tractor assembly includes a toroidal shaped fluid filled membrane mounted over a body and a drive system coupled with the membrane. The drive system includes a helical flight that inverts the membrane when rotated against its inner surface. A mid-section of the body includes sleeve like portions that telescope with one another and shorten a length of the body. Fluid in the membrane is forced from the mid-section and radially expands a forward portion and into contact with an inner surface of the passage, so that when the membrane is inverted while in a passage, frictional contact between the membrane and inner surface of the passage creates a force that urges the tractor assembly through a passage.

13 Claims, 4 Drawing Sheets

WELLBORE TRACTOR WITH INVERTED TOROID

BACKGROUND OF THE INVENTION

1. Field of Invention

The present disclosure relates to a wellbore tractor, and more particularly to a wellbore tractor that includes a drive system with an inverted toroid.

2. Description of Prior Art

Invasively navigating a probe or tool through passages that project through a mass, such as subterranean wellbore or arteries of a patient, typically involves tethering the probe/tool to an end of a semi-rigid elongated member and deploying/pushing the probe/tool through the passage. In wellbores the elongated member is often coiled tubing or wireline, and in a medical setting the elongated member is generally a wire. Some passages having deviated and/or tortuous portions cannot be navigated by pushing the probe/tool with an elongated member as the member lacks the requisite combination of flexibility and strength.

Tractor assemblies are sometimes used to overcome difficulties encountered with deviated passages. Tractors typically include a gripper portion that is selectively articulated away from the probe/tool and into contact with and pushing against an inner wall of a passage. The pushing by the gripper in turn motivates the probe/tool through the deviated or lateral section. Example grippers include wheels or rollers on the end of a gripper arm, or linkage assemblies that pivot out and push the tool along in an inchworm fashion. The tractor assemblies are often powered by a hydraulic system that is selectively pressurized for activating the grippers of the tractor assemblies.

SUMMARY OF THE INVENTION

Disclosed herein is an example of a tractor assembly for use in a wellbore that includes a body having annular forward and aft portions that selectively telescope with respect to one another between extended and retracted configurations of the body, an annular space extending axially through the body, a drive system in the annular space, and a membrane mounted onto the body and formed into an elongated toroid and that is selectively inverted when the drive system is energized, the membrane having a forward section that radially expands into contact with an inner surface of the wellbore when the body is in the retracted configuration, so that when the membrane is inverted contact between the membrane and inner surface of the wellbore generates a resultant force that displaces the tractor assembly within the wellbore. The of tractor assembly optionally has fluid inside the membrane, and in an alternative the drive system includes a helical flight. In an example a retaining bearing system is included that is in a rearward section of the assembly. The of tractor assembly optionally includes a motor section coupled with the body. In an alternative, the assembly has a drive shaft for transferring rotational motion from the motor section to the helical flight. In embodiments, the assembly is selectively coupled and decoupled to and from a conveying means. In an alternative, a coupling is in selective attachment to a wellbore tool.

Also disclosed herein is a method of operating a tractor assembly in a wellbore that includes obtaining a wellbore tractor assembly comprising a membrane formed into an elongated toroid, radially expanding a portion of the membrane into contact with an inner surface of the wellbore, and continuously inverting the membrane to generate a force between the membrane and inner surface of the wellbore to propel the tractor assembly within the wellbore. In an example, the membrane is inverted by rotating a helical flight against a surface of the membrane. Fluid optionally is in the membrane. A wellbore tool is optionally pulled inside the wellbore with the tractor. In this example, the wellbore tool is a tool, such as, an imaging tool, a perforating tool, a completion tool, a survey tool, or a combination. This example further includes the option of reversing rotation of the helical flight and reversing direction in the wellbore.

BRIEF DESCRIPTION OF DRAWINGS

Some of the features and benefits of the present invention having been stated, others will become apparent as the description proceeds when taken in conjunction with the accompanying drawings, in which.

Figure 1:
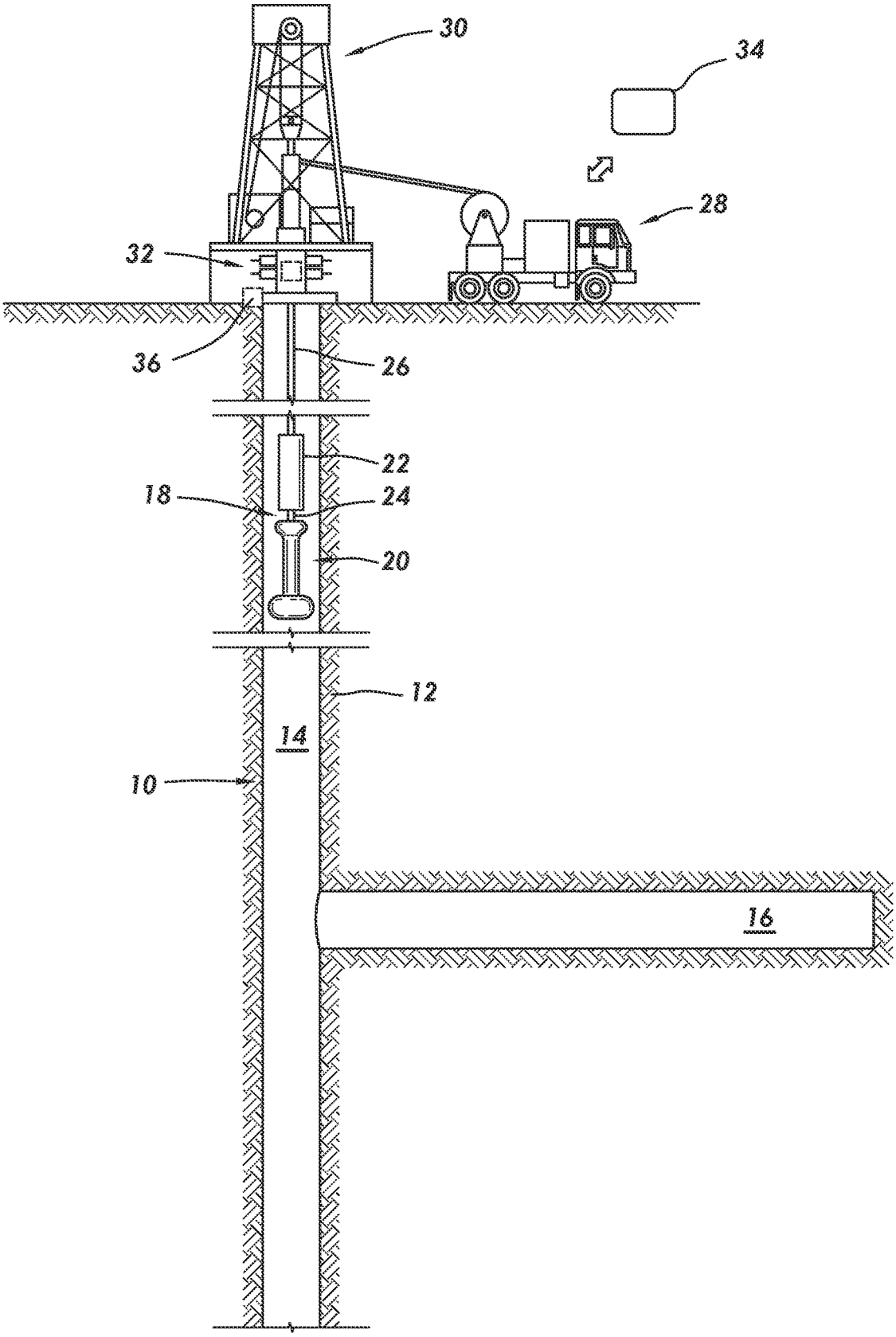
FIG. 1 is a side partial sectional view of an example of a tractor assembly being deployed into a wellbore circuit.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a partial side sectional view of an example of operations in a wellbore circuit 10 shown formed in a subterranean formation 12. The circuit 10 includes a primary bore 14 (or motherbore) shown having a generally vertical orientation, and which is intersected by a lateral bore 16 that projects from a sidewall of the primary bore 14. In a non-limiting example of operation, a wellbore tractor assembly 18 is being shown lowered into the circuit 10 and within the primary wellbore 14. The wellbore tractor assembly 18 includes a tractor unit 20 shown on its lower end and a motor section 22 on an upper end of the assembly 18. The assembly 18 further includes a coupling 24 between the tractor unit 20 and motor section 22 and which provides mechanical and electrical connection between the unit 20 and section 22. An elongate conveyance line 26 is used for deploying the tractor assembly 18 downhole. Examples of the conveyance line 26 include a wireline, slickline, coiled tubing, and combinations. An end of line 26 opposite assembly 18 is coupled with a service truck 28 shown on surface and being unspooled from a reel on the truck 28. Further in the example shown, the line 26 is routed through a derrick 30 also on surface and inserted through a wellhead assembly 32 mounted on an open end of wellbore 14. A controller 34 is schematically shown in communication with service truck 28 via communication means, and alternatively controller 34 is in communication with the tractor assembly 18 through connection of line 26 with service truck 28. Further optionally included are modules 36 shown on wellhead assembly 32 and within an upper end of wellbore 14 and which provides monitoring and control of the wellbore 14 and communications with tractor 18 as well as with controller 34.

Figure 2A:
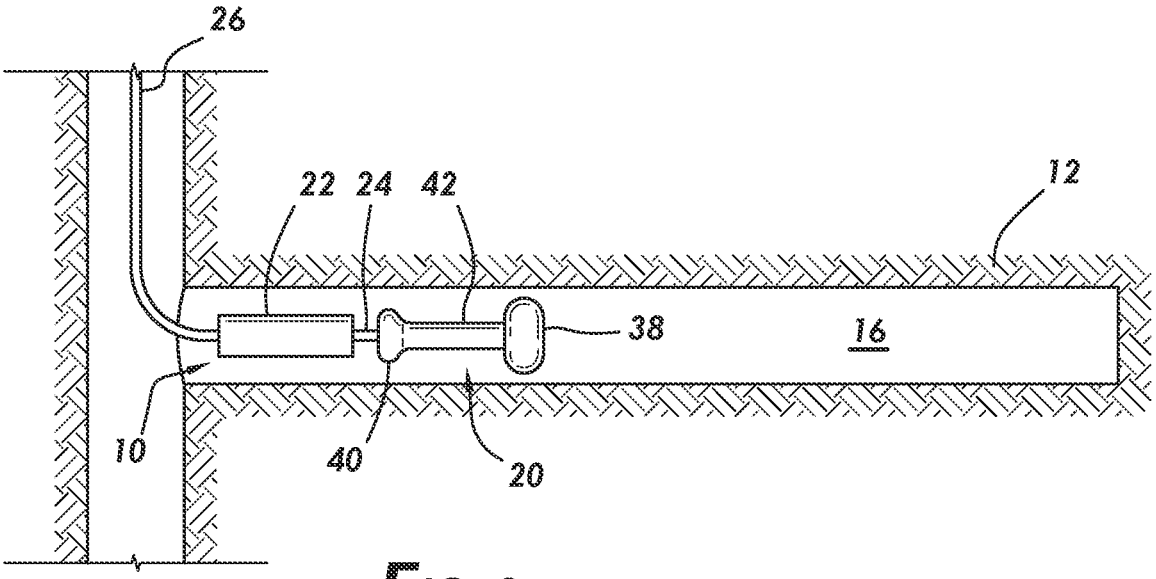
FIG. 2*a* is a side partial sectional view of an example of the tractor assembly being inserted into a lateral wellbore of the wellbore circuit of FIG. 1.
Figure 2B:
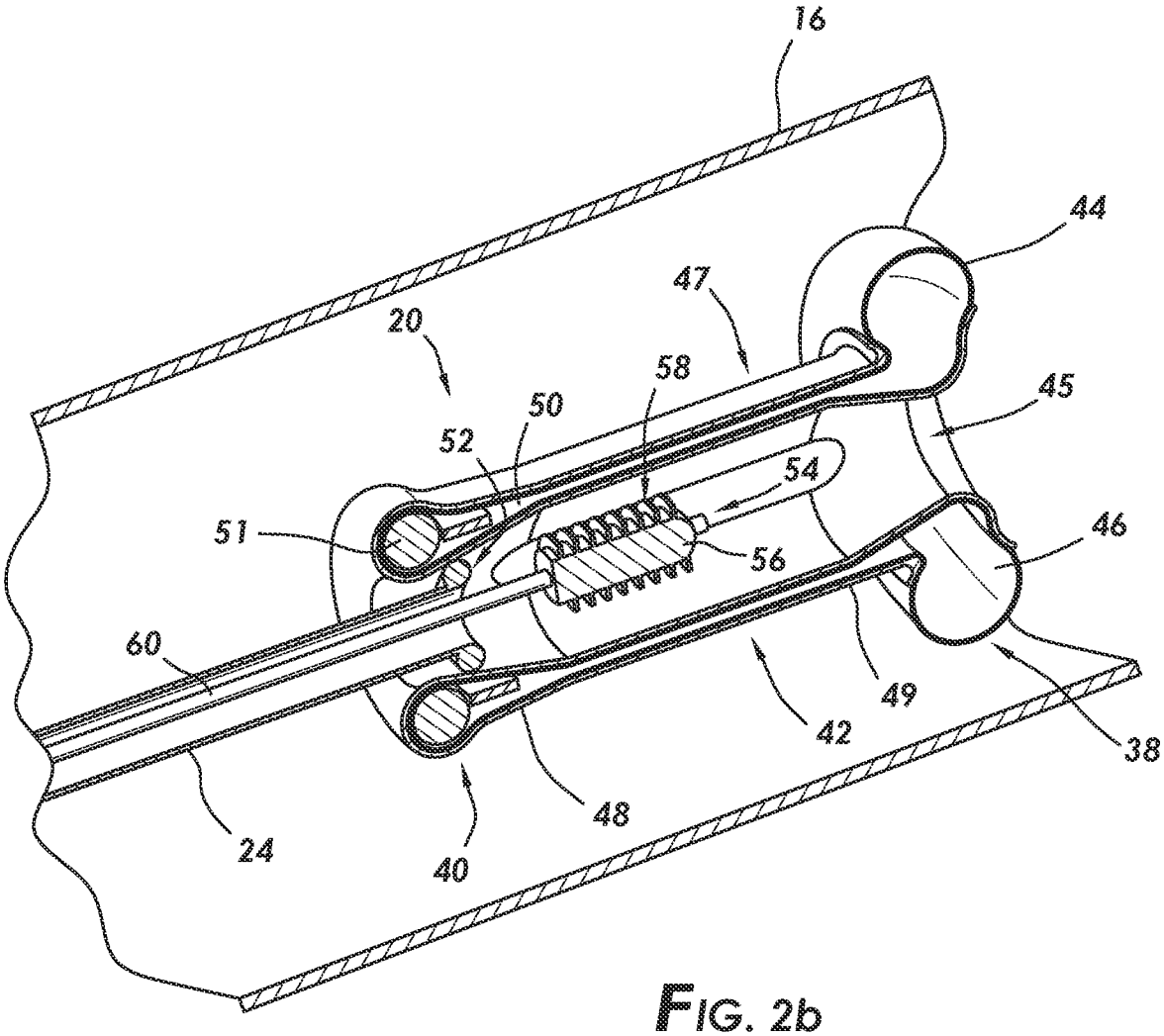
FIG. 2*b* is a perspective sectional view of the tractor assembly of FIG. 2*a*.

FIG. 2*a* is a side partial sectional view of one example of the tractor unit 20 being inserted into lateral bore 16 and on an end of line 26. A whipstock (not shown) optionally is included for diverting the tractor assembly 20 into lateral bore 16 and from the primary bore 14. In the example of FIG. 2*a*, the tractor assembly 20 is shown as having a forward section 38 on a lowermost or terminal end, and opposite the forward section 38 is a rearward section 40 shown adjacent the coupling 24. An elongate midsection 42 spans between, and is in connection with, the forward and rearward sections 38, 40. Referring now to FIG. 2*b*, a sectional view of an example of the tractor unit 20 illustrates that a membrane 44 covers the outer surface of the unit 20 and membrane 44 is configured into an elongate toroid. In this shape, an annular space 45 projects axially through the unit 20. Example materials for making up all or part of the membrane 44 include elastomers that are flexible and that are able to withstand temperatures in a wellbore as well as exposure to solvents, wellbore additives, contaminants and other substances present downhole. Specific examples of materials for making up all or part of the membrane 44 include: fluoroelastomers, fluoropolymers, copolymers of propylene and tetrafluoroethylene (such as those sold under the tradename of AFLAS® and available from SSP Manufacturing, Inc. 83 Spring Lane, Hackettstown, New Jersey 07840), and polymers formed by polymerization of one or more of vinyl fluoride, hexafluoropropylene, and tetrafluoroethylene (such as that sold under the VITON® tradename and available from the Chemours Company, 1007 Market Street, P.O. Box 2047, Wilmington, Delaware 19899). Further included in this example is fluid 46 in the enclosed space within membrane 44. A body 47 is provided within the unit 20 and along the midsection 42 and partially into the forward and rearward sections 38, 40. Body includes inner and outer walls and provides a backstop surface for the membrane 44 along the outer surface of the midsection 42 and along the inner surface of the annular space 45. Body 47 includes an aft portion 48 that is adjacent the rearward section 40 and forward portion 49 adjacent the forward portion 38. The radial spacing apart of the inner and outer walls of the body 47 forms an annular plenum 50 with a length projecting along an axis of the unit 20 and is in fluid communication with the forward and rearward sections 38, 40.

Still referring to FIG. 2*b*, an optional retaining bearing system 51 is shown disposed within the rearward section 40, retaining bearing system 51 is illustrated as an annular member with an outer diameter exceeding that of the midsection 42. An example of attachment between coupling 24 and unit 20 includes a harness 52, which is illustrated as an annular ringlike member having a diameter greater than diameter of annular space 45 at a rearward terminal end of the unit 20. The smaller diameter portion of the space 45 interferes with harness 52 movement from within unit 20, which forms an interference fit to maintain engagement of harness 52 and coupling 24 with the unit 20. Disposed within the annular space 45 and in the midsection 42 is a propulsion member 54, which includes a cylindrically shaped body 56; a helically shaped flight 58 circumscribes the outer surface of body 56 and along substantially the entire length of the body 56. An end of body 56 proximate the rearward section 40 attaches to a drive shaft 60. An end of drive shaft 60 opposite body 56 connects to a motor (not shown) provided within motor section 22 (FIG. 2*a*). In the examples of FIGS. 2*a* and 2*b*, unit 20 is in an extended configuration.

Figure 3A:
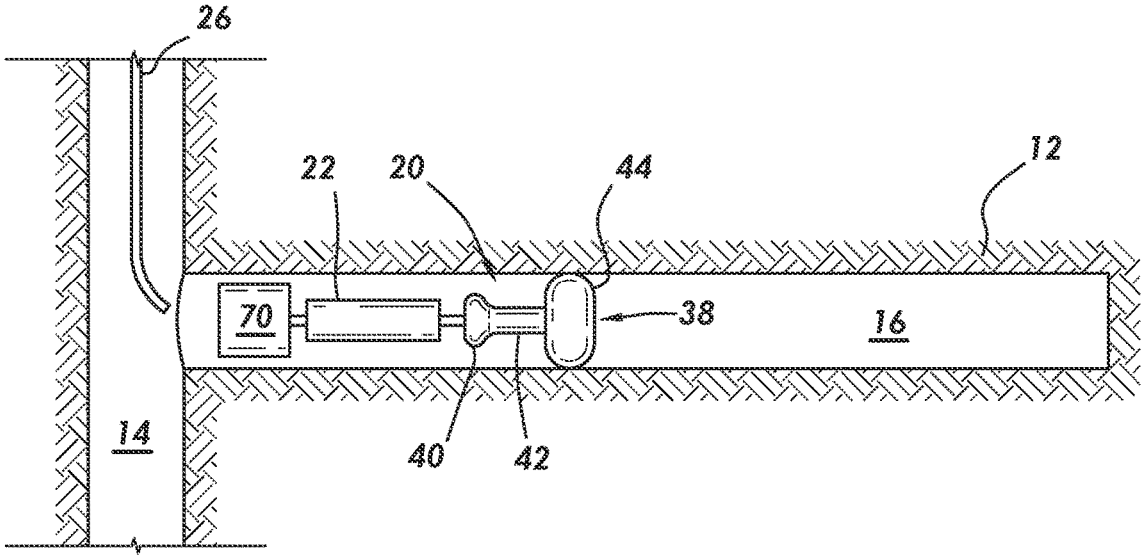
FIG. 3*a* is a side partial sectional view of an example of the tractor assembly navigating within the lateral wellbore of FIG. 2*a*.

Referring now to FIG. 3*a*, shown in a partial side sectional view is an example of the unit 20 in a retracted configuration. When the unit 20 is in the retracted configuration, the forward section 38 is radially expanded into contact with sidewalls of lateral bore 16. In alternatives, one or more of primary bore 14 and lateral bore 16 are openhole, or alternatively, partially or fully lined with casing or other tubular members. In the retracted configuration, walls in the body 47 and midsection 42 portion of unit 42 have telescoped with respect to one another to reduce a length $L_{42}$ of midsection 42. Reconfiguring assembly 20 into the retracted configuration forces fluid 46 from within plenum 50 into the space within membrane 44 in the forward section 38, which allows the radial expansion of forward section 38 and into contact with sidewalls of bore 16. In alternatives, the unit 20 is reconfigured from the retracted to the extended configuration. Examples of actuators (not shown) for reconfiguring the unit 20 include elongated threaded members (e.g., jackscrews) with associated motors, electroactive polymers, and combinations). These actuators are optionally provided in the plenum 50. Body 47 is formed from a substance with material properties so that the body 47 is self-supporting and maintains its shape when subjected to anticipated downhole temperature and pressure conditions in conjunction with forces applied from the membrane 44 during operation. Examples of material making up the body 47 include polymers, ceramics, metal alloys, and combinations.

Figure 3B:
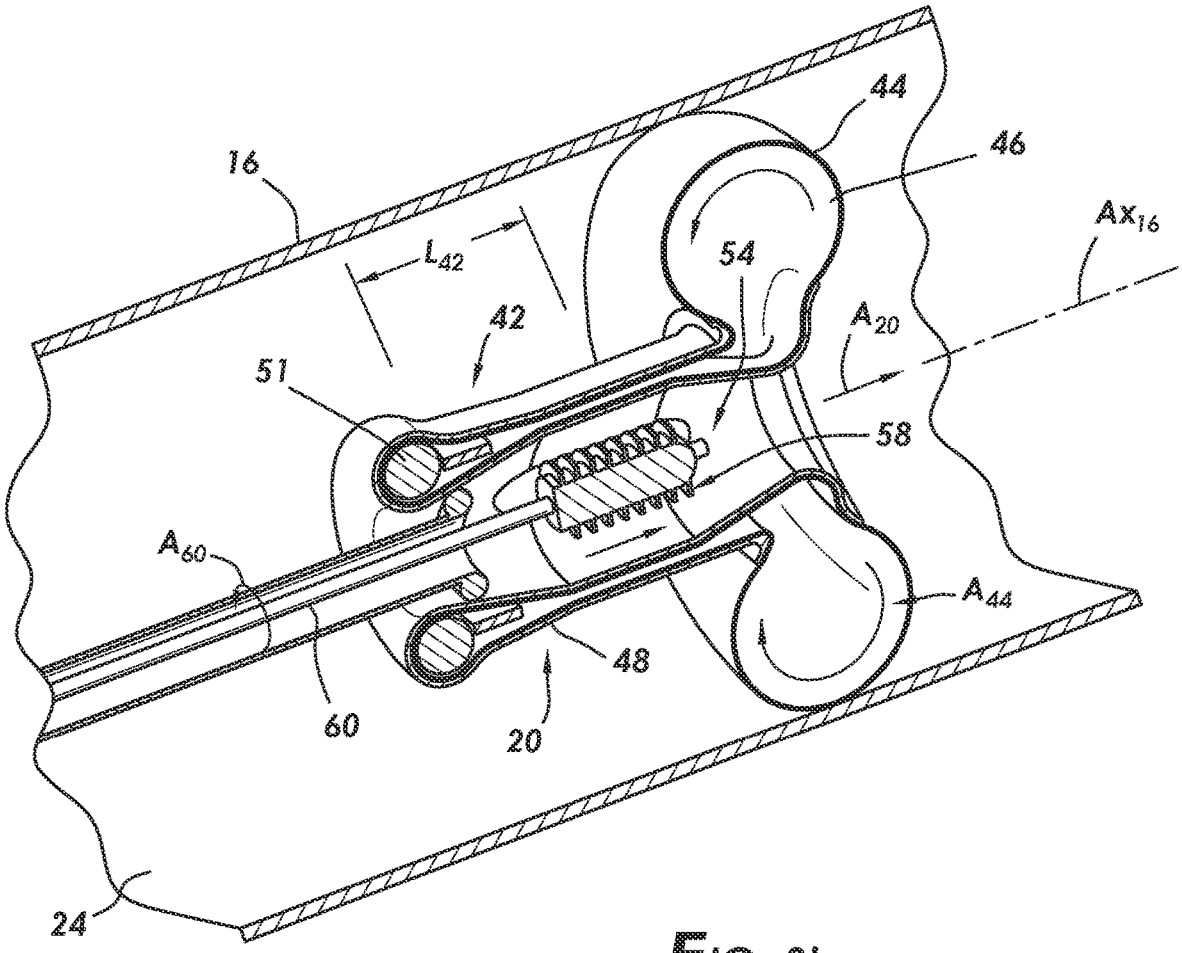
FIG. 3*b* is a perspective sectional view of the tractor assembly of FIG. 3*a*.

Still referring to FIG. 3*b*, shaft 60 is shown being rotated, such as by rotation of motor (not shown), and in a direction illustrated by arrow $A_{60}$, that in turn creates rotation of member 54. Motor is optionally powered by electricity delivered downhole along line 26 or by a battery (not shown) included with the motor section 22. With the flights 58 in contact with the surface of membrane 44 in the annular space 45, a force is imparted onto membrane and causing the membrane 44 to invert, so that the portion of membrane 44 around the forward portion 38 moves with respect to sidewalls of bore 16 in direction illustrated by arrow $A_{44}$.

Frictional contact between membrane 44 and sidewalls of bore 16, in combination with the relative movement of membrane 44, generates a resultant force for causing movement of tractor unit 20 within bore 16 in a direction along axis $Ax_{16}$ and arrow $A_{20}$.

Figure 4:
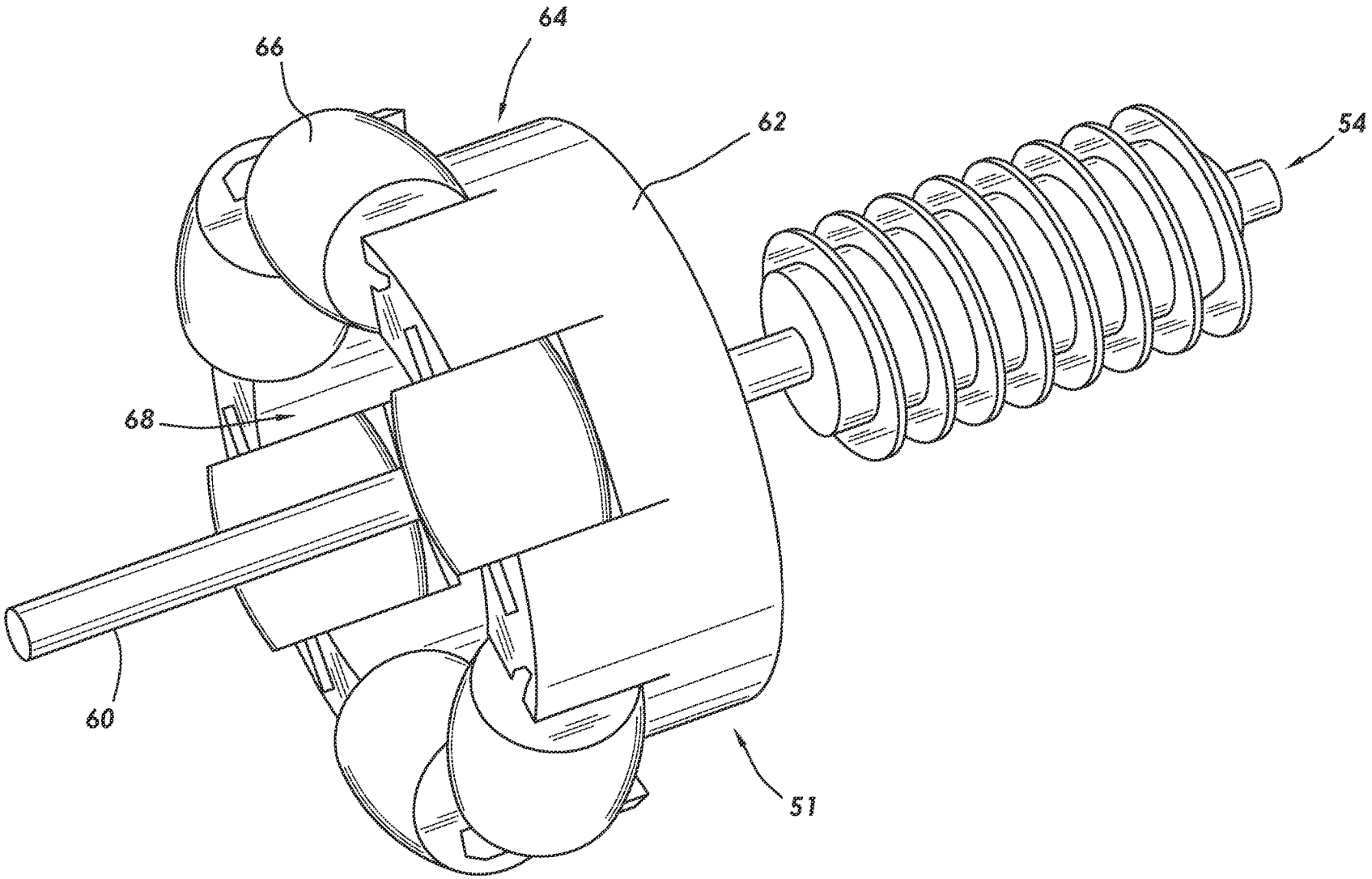
FIG. 4 is a perspective view of an example of a portion of the tractor assembly of FIG. 1.

Referring now to FIG. 4, shown in a perspective view is an example of the unit 20 and with the retaining bearing system 51 circumscribing shaft 60. In the example shown, bearing system 51 includes an annular base 62 with a rectangular cross section, slots 64 are on an edge of the base 62 facing away from the propulsion member 54 and that receive bearings 66 within. An annulus 68 is formed through the base 62 and in which is intersected by the shaft 60.

In a nonlimiting example of operation, a downhole tool 70 is attached to an end of motor section 22 opposite from unit 20. Examples of downhole tool 70 include an imaging tool, such as one employing acoustics, electromagnetic sensors, nuclear-magnetic sensors, and combinations. In alternatives tool 70 includes a perforating device with perforators (not shown) for creating perforations within the wellbore 14 or wellbore 16. Further optionally, wellbore tool 70 is for monitoring conditions downhole, and includes sensors for measuring one or more of pressure, temperature, fluid conditions, fluid constituents, and fluid properties. Regarding the fluid 46, examples of the fluid 46 include hydraulic fluid, oil, water, dielectric fluid, and highly viscus fluid such as grease.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A tractor assembly for use in a wellbore comprising:

a body having annular forward and aft portions that selectively telescope with respect to one another between extended and retracted configurations of the body;

a space extending axially through the body;

a helical flight in the space; and a membrane mounted onto the body and formed into an elongated toroid and that is selectively inverted when the helical flight is rotated, the membrane having a forward section that radially expands into contact with an inner surface of the wellbore when the body is in the retracted configuration, so that when the membrane is inverted contact between the membrane and inner surface of the wellbore generates a resultant force that displaces the tractor assembly within the wellbore.

2. The tractor assembly of claim 1, further comprising fluid inside the membrane.

3. The tractor assembly of claim 1, further comprising a retaining bearing system in a rearward section of the assembly.

4. The tractor assembly of claim 1, further comprising a motor section coupled with the body.

5. The tractor assembly of claim 4, further comprising a drive shaft for transferring rotational motion from the motor section to the helical flight.

6. The tractor assembly of claim 1, wherein the assembly is selectively coupled and decoupled to and from a conveyance line.

7. The of tractor assembly of claim 1, wherein the tractor assembly is attached to a wellbore tool.

8. A method of operating a tractor assembly in a wellbore comprising:

obtaining a wellbore tractor assembly comprising a membrane formed into an elongated toroid;

radially expanding a portion of the membrane into contact with an inner surface of the wellbore; and continuously inverting the membrane by rotating a helical flight against a surface of the membrane to generate a force between the membrane and inner surface of the wellbore to propel the tractor assembly within the wellbore.

9. The method of claim 8, wherein the membrane is inverted by rotating a helical flight against a surface of the membrane.

10. The method of claim 8, wherein there is fluid in the membrane.

11. The method of claim 8, further comprising pulling a wellbore tool inside the wellbore with the tractor.

12. The method of claim 11, wherein the wellbore tool comprises a tool selected from the group consisting of an imaging tool, a perforating tool, a completion tool, a survey tool, and combinations thereof.

13. The method of claim 9, further comprising reversing rotation of the helical flight and reversing direction in the wellbore.

* * * * *